United States Patent [19]

Bulso, Jr. et al.

[11] Patent Number: 4,977,772

[45] Date of Patent: Dec. 18, 1990

[54] METHOD AND APPARATUS FOR FORMING REFORMING AND CURLING SHELLS IN A SINGLE PRESS

[75] Inventors: Joseph D. Bulso, Jr., Canton; James A. McClung, North Canton, both of Ohio

[73] Assignee: Redicon Corporation, Canton, Ohio

[21] Appl. No.: 485,180

[22] Filed: Feb. 26, 1990

Related U.S. Application Data

[63] Continuation-in-part of Ser. No. 239,948, Sep. 2, 1988, Pat. No. 4,903,521.

[51] Int. Cl.[5] ..... B21D 22/00

[52] U.S. Cl. ..... 72/336; 72/348; 72/361

[58] Field of Search ..... 72/329, 336, 348, 361

[56] References Cited

U.S. PATENT DOCUMENTS

| | | | |
|---|---|---|---|
| 184,708 | 11/1876 | Gordon . | |
| 1,275,614 | 8/1918 | Sherman . | |
| 1,984,774 | 12/1934 | Stogner, Sr. | 113/42 |
| 2,695,583 | 11/1954 | Swarr | 113/80 |
| 3,704,618 | 12/1972 | Cvacho et al. | 72/336 |
| 3,812,953 | 5/1974 | Maschke | 198/131 |
| 3,902,347 | 9/1975 | Ridgway et al. | 72/336 |
| 4,483,172 | 11/1984 | Bulso, Jr. et al. | 72/349 |
| 4,516,420 | 5/1985 | Bulso, Jr. et al. | 72/329 |
| 4,535,618 | 8/1985 | Bulso, Jr. et al. | 72/349 |
| 4,549,424 | 10/1985 | Bulso, Jr. et al. | 72/329 |
| 4,561,280 | 12/1985 | Bachmann et al. | 72/346 |
| 4,567,746 | 2/1986 | Bachmann et al. | 72/348 |
| 4,574,608 | 3/1986 | Bulso, Jr. et al. | 72/348 |
| 4,587,825 | 5/1986 | Bulso, Jr. et al. | 72/329 |
| 4,587,826 | 5/1986 | Bulso, Jr. et al. | 72/329 |
| 4,588,066 | 5/1986 | Kaminski | 198/345 |

*Primary Examiner*—Lowell A. Larson
*Attorney, Agent, or Firm*—Reese Taylor

[57] ABSTRACT

A method of forming container end panels from a sheet of material includes inserting the material into a press at a first level, blanking the material at that level, passing the material through a die and preliminarily forming it in a continuous stroke but at a second level and transferring it laterally at the second level for reforming and curling. The apparatus includes blanking and forming tooling at a first station and reforming and curling tooling at second and third stations. The reforming and curling tooling is disposed at the second level and the first, second and third stations are interconnected by an endless, apertured belt also disposed at the second level. An alternative embodiment involves disposing the first station tooling at an angle with respect to the press centerline, feeding the material into the press in a first direction and moving the preliminarily formed ends in opposite directions normal to the feed direction to second and third stations disposed on opposite ends of the press.

23 Claims, 16 Drawing Sheets

METHOD AND APPARATUS FOR FORMING REFORMING AND CURLING SHELLS IN A SINGLE PRESS

RELATED PATENT APPLICATIONS

This Application is a continuation-in-part of our earlier filed Application, Ser. No. 239,948, filed Sept. 2, 1988, now U.S. Pat. No. 4,903,521 granted Feb. 27, 1990.

BACKGROUND OF THE INVENTION

This invention relates in general to a system, method and apparatus for forming container end panels, commonly called shells, form a sheet of material and relates in particular to such a system in which the entire operation on the end panel from the initial raw material to the finished end, including blanking, forming, reforming and curling, is accomplished in a single press, while positively controlling the shells throughout the process and greatly increasing the speed of operation.

DESCRIPTION OF THE PRIOR ART

The forming of ends or shells for containers can be seen from Bulso U.S. Pat. Nos. 4,516,420 and 4,549,424 and the reforming thereof can be seen in Bulso U.S. Pat. Nos. 4,587,825 and 4,587,826. Similarly, curling operations and apparatus can be seen in Bulso U.S. Pat. No. 4,574,608. Through the die forming of containers per se can be seen in Bulso U.S. Pat. Nos. 4,483,172 and 4,535,618.

Also, representative of the prior patent art are Bachmann U.S. Pat. Nos. 4,561,280 and 4,567,746 which disclose methods and apparatus for making shells for cans including imparting a curl edge to the finished product. Additionally, Maschke U.S. Pat. No. 3,812,953 and Kaminski U.S. Pat. No. 4,588,066 are relevant as disclosing article transfer by apertured, endless belts.

Thus, the various operations contemplated in the present application are, to at least some extent, in and of themselves known to the art. Accordingly, it is known to blank material from a sheet or coil; it is known to form and reform the material; and it is known to curl the peripheral edge for a double seaming operation. However, the combination of all of these features in a single press capable of extremely high speed operation with a minimal amount of handling of the end panel or shell has not heretofore been known in the art and it is this unique combination which is the subject of the present application.

In that regard, in a conventional operation, where, for example, the shells are formed and then converted to pull tab ends, the press will have tooling capable of forming twenty-two shells per stroke. Thus, such a twenty-two out press, operating at one hundred fifty strokes per minute, would produce thirty-three hundred shells per minute.

However, typical conversion equipment can convert forty-two hundred shells per minute. Thus, in order to take advantage of the conversion capacity, it would normally be necessary to add a second shell press which doubles the shell production cost. Since the goal is to reduce the cost per thousand, this is not a satisfactory solution.

An alternative solution is to speed up the shell press. However, control of the ends becomes a serious problem at higher speeds and leads to damaged ends which is counterproductive.

Accordingly, Applicants have found, by a combination of multi-level feeding and handling and positive belt transfer, that speeds of up to or exceeding two hundred strokes per minute can be achieved without undue end damage.

Such a system makes it possible to eliminate transfer line interferences, reduce tooling stations and machine manning while enabling the shell technology to keep pace with the conversion technology and reduce the cost per thousand.

SUMMARY OF THE INVENTION

It, accordingly, becomes an object of the present invention to combine in a single press the functions of blanking, forming, reforming and die curling.

It is also an object of this invention to achieve in a single press the various operations just referred to with a minimal amount of handling of the article and with positive control during the various forming steps as well as during the transfer steps.

It has been found that these objects can be achieved by feeding the stock into the press at one level, providing for blanking, drawing and redrawing in a single station by passing the material through the die and depositing it in an apertured belt on a different level for transfer to a reforming and curling station. It has been found that in this fashion no handling of the article is required through the blanking, drawing and reverse drawing operations, thereby minimizing the risk of damage to either the article or to the coating which the article carries in many instances. It has also been found that the multi-level approach avoids transfer line interference problems while permitting very high speed operation.

It has also been found that, by arranging the tooling stations so that the blank, draw and redraw stations are arranged along the axis of feed of the material and then disposing the reforming and curling stations laterally with respect to the direction of feed, a positive belt transfer can be employed even with extremely lightweight materials which are not readily susceptible to effective transfer by air at very high press speeds.

It has also been found that, in an alternative form of the invention, the basic advantages just described can be achieved and access to the tooling can be improved by arranging the tooling sets diagonally with respect to the long axis of the press, feeding the material into the press in a first direction and then moving the pieces formed in the first operation in opposed directions, both normal to the feed direction for subsequent operations.

It has also been found that, in the alternative form of the invention, such secondary forming functions as pre-curling, curling and reforming can be performed more efficiently by performing them with tooling carried by the outer press slide and eliminating such activating means as cams and cam followers as are employed in the principal embodiment.

Accordingly, production of an improved method and apparatus for forming, reforming and curling shells in a single press becomes the principal object of this invention with other objects thereof becoming more apparent upon a reading of the following brief specification considered and interpreted in view of the accompanying drawings.

BRIEF DESCRIPTION OF THE EMBODIMENTS

It will first be noted that the invention is illustrated in a double acting press wherein the press has inner and outer slides, each of which carries certain tooling and each of which is capable of being operated and adjusted independently of the other so that the tooling carried by a particular slide can perform its functions independently of, but in coordination with, the tooling of the other slide. Such presses are well-known in the art and a representative one can be seen in Ridgway U.S. Pat. No. 3,902,347.

Figure 1:
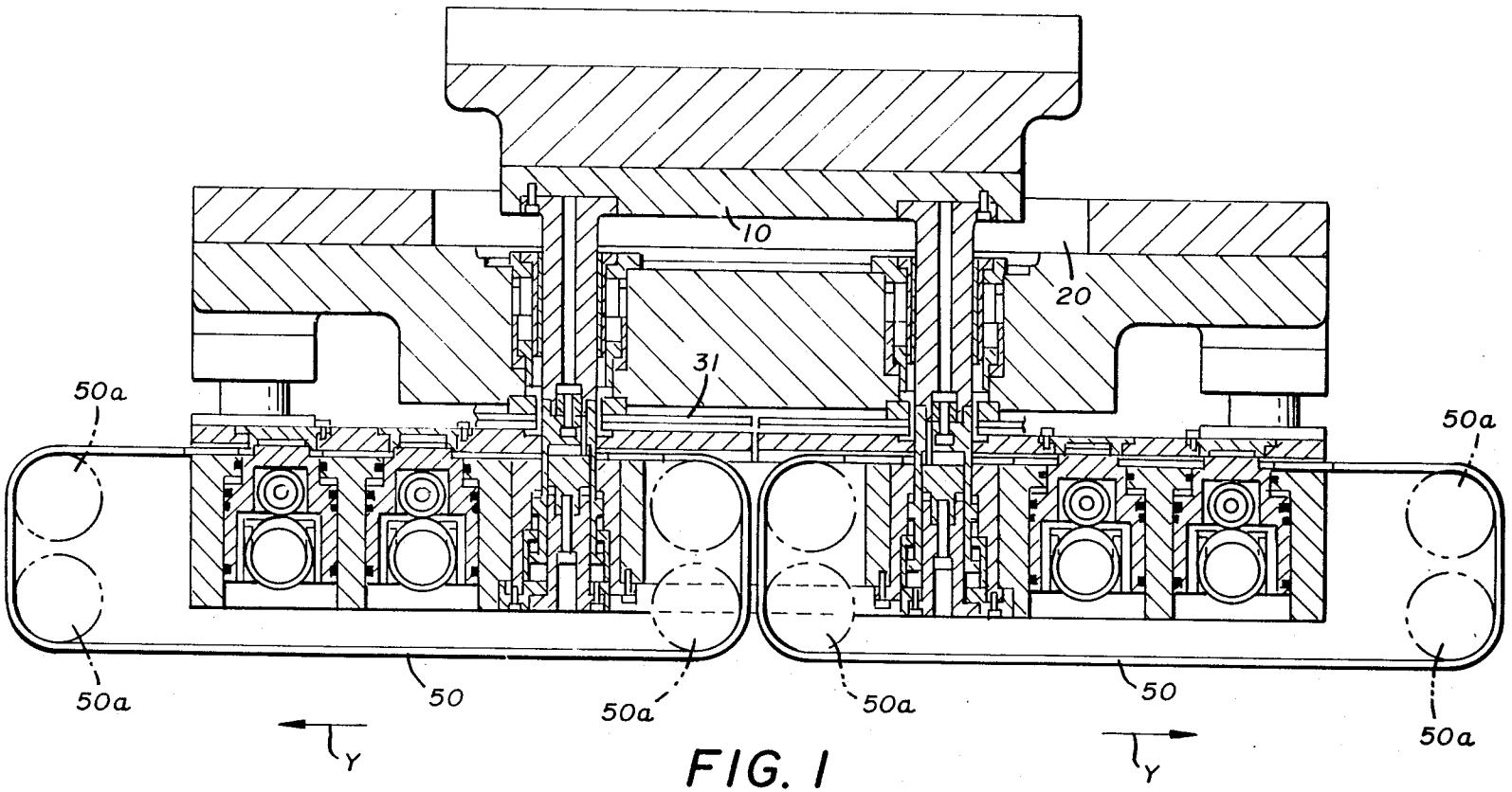
FIG. 1 is an elevational view, partially in section, showing the overall arrangement of the system.
Figure 2:
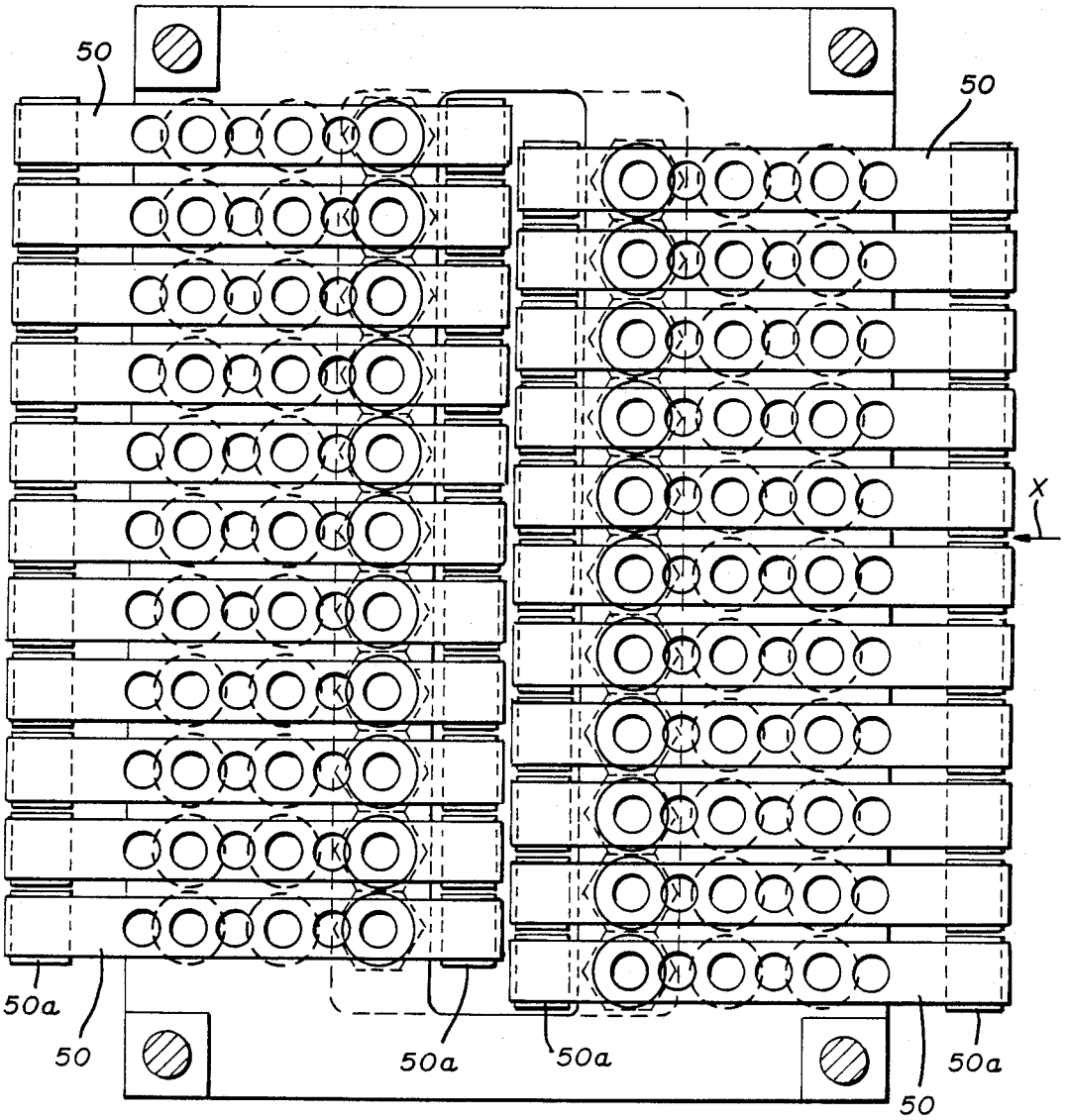
FIG. 2 is a plan view of the tooling layout showing the blanking position.

Referring first to FIGS. 1 and 2 of the drawings, the overall arrangement can be clearly seen. As previously noted, the double acting press includes inner and outer slide holders 10 and 20 which carry the tooling for blanking and preliminarily forming the shell. These slide holders are movable toward and away from the press base as is conventional.

The tooling is arranged as shown in FIGS. 1 and 2 along the axis of feed X of the material into the press so that, as the material is fed along axis X, each cycle of the press will enable the tooling to blank and form shells in a number corresponding to the sets of tooling. In the illustrations of FIGS. 1 and 2, this amounts to twenty-two (eleven on each side of the centerline).

FIGS. 1 and 2 also illustrate how the arrangement permits utilization of a belt transfer since, once the shells are preliminarily formed, they are moved out of the preliminary forming stations to the secondary stations on belts 50,50 in the directions Y. It should be noted here that the invention contemplates what may be called a multi-level arrangement. Thus, referring to FIGS. 1, 2 and 3, the material is fed into the press in the direction X (See FIG. 2) along a stock plate 31 (See FIG. 3) which is disposed on a first level and the preliminarily formed shell is transferred for reforming and curling in the direction of arrows Y (See FIG. 2) on belts 50,50 (See FIG. 1) disposed on a second level. This avoids any transfer line interference.

It will also be noted from FIG. 1 that there are two parallel sets of tooling mounted in the press and that, after preliminarily forming the shells, are moved away from those sets of tooling in opposite directions Y,Y for subsequent operations.

In the following detailed description, it should be remembered that operation on only one workpiece will be considered, although the operations and tooling will be repeated twenty-two times for each cycle in the example illustrated.

Figure 3:
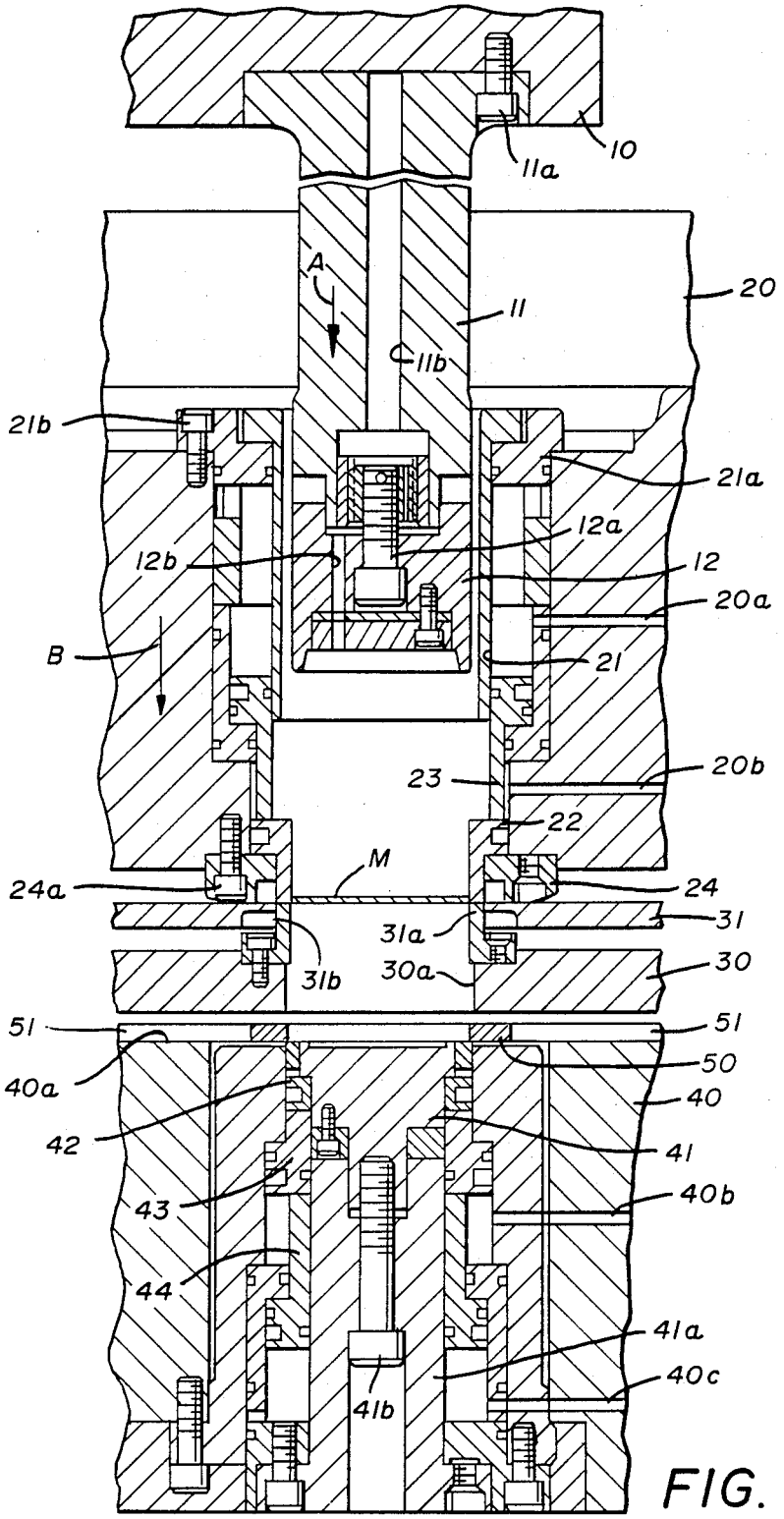
FIG. 3 is an elevational assembly view, partially in section, showing one set of tooling in the blanking position.

With that in mind and referring next to FIGS. 1 and 3 of the drawings, it will be seen that an inner slide holder 10 and an outer slide holder 20 are again illustrated. As noted previously, the drawings illustrate twenty-two sets of tooling carried by these slide holders. Only one tooling set will be described in detail herein.

Thus, the inner slide holder 10 carries a punch riser 11 secured thereto by one or more bolts 11*a*. The projecting end of the punch riser 11 carries a punch 12 secured thereto in adjustable fashion by the screw 12*a*. In this fashion, the tooling such as punch 12 can be moved toward and away from the fixed base of the press as slide holder 10 moves toward and away from the base.

The outer slide holder 20 has an appropriate hollow cavity within which the punch riser 11 and punch 12 of the inner slide holder 10 reciprocate substantially independently of the movement of the outer slide holder.

This outer punch holder 20 also carries with it certain tooling. First, inboard is a sleeve 21 secured thereto by retainer 21*a* and screws 21*b* so as to be reciprocal therewith. Outboard of the sleeve 21 and in concentric surrounding relationship therewith is a first pressure sleeve 22 and a fluid actuated piston 23 which acts thereon. Secured to the projecting bottom end of the outer punch holder 20 is a cut edge 24 which is secured by one or more screws 24*a*.

The fluid actuated piston 23 is carried by outer punch holder 20 above first pressure sleeve 22 and is controlled by fluid introduced through bore 20*a* and vented through bore 20*b* with bore 20*a* being connected to a suitable source of fluid supply (not shown).

Disposed beneath the inner and outer slide holders 10 and 20 is bolster plate 40 and die holder 30. This bolster plate 40 has a central cavity therein which receives a die core 41 mounted on a die core riser 41*a* and secured thereto by screw 41b. Surrounding the die core 41 and die core riser 41a is a knockout piston 42 which is supported by fluidly actuated pistons 43 and 44.

Disposed just above the top surface 40a of the base 40 is an apertured belt 50 which has a plurality of apertures 51,51 which are sized appropriately so as to receive an end, as will be described. This belt is movable along top surface 40a of bolster plate 40 by suitable drive means 50a,50a which may take the form of toothed wheels (see FIGS. 1 and 2), at least one of which is driven. A stock plate 31 and a die holder 30 are also disposed between the slide holders 10 and 20 and the bolster plate 40, as can clearly be seen in FIG. 3 of the drawings. As previously noted, in keeping with the multi-level aspects of the invention, the stock plate 31 is disposed at a first level while the belt 50 is disposed at a second, lower level.

Figure 3A:
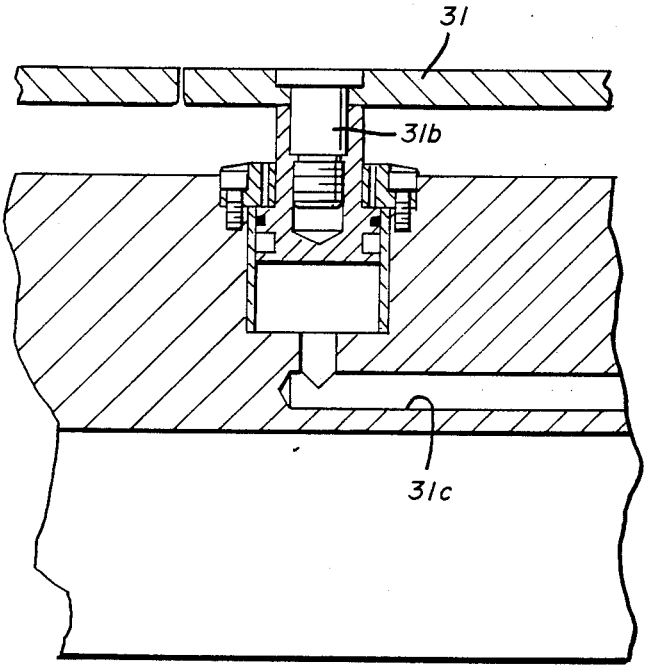
FIG. 3A is an enlarged fragmentary sectional view, partially in section, showing the stock plate support.

The stock plate 31 is supported by one or more fluid supported pistons as can be seen in the enlarged view of FIG. 3A wherein plate 31 is supported by piston 31b which, in turn, is supported by fluid supplied through bore 31c.

The die holder 30 also carries on it a punch shell and cut edge 31a which cooperates with cut edge 24 and stock plate 31 and blanks the material, as will be described subsequently in greater detail.

Figure 7:
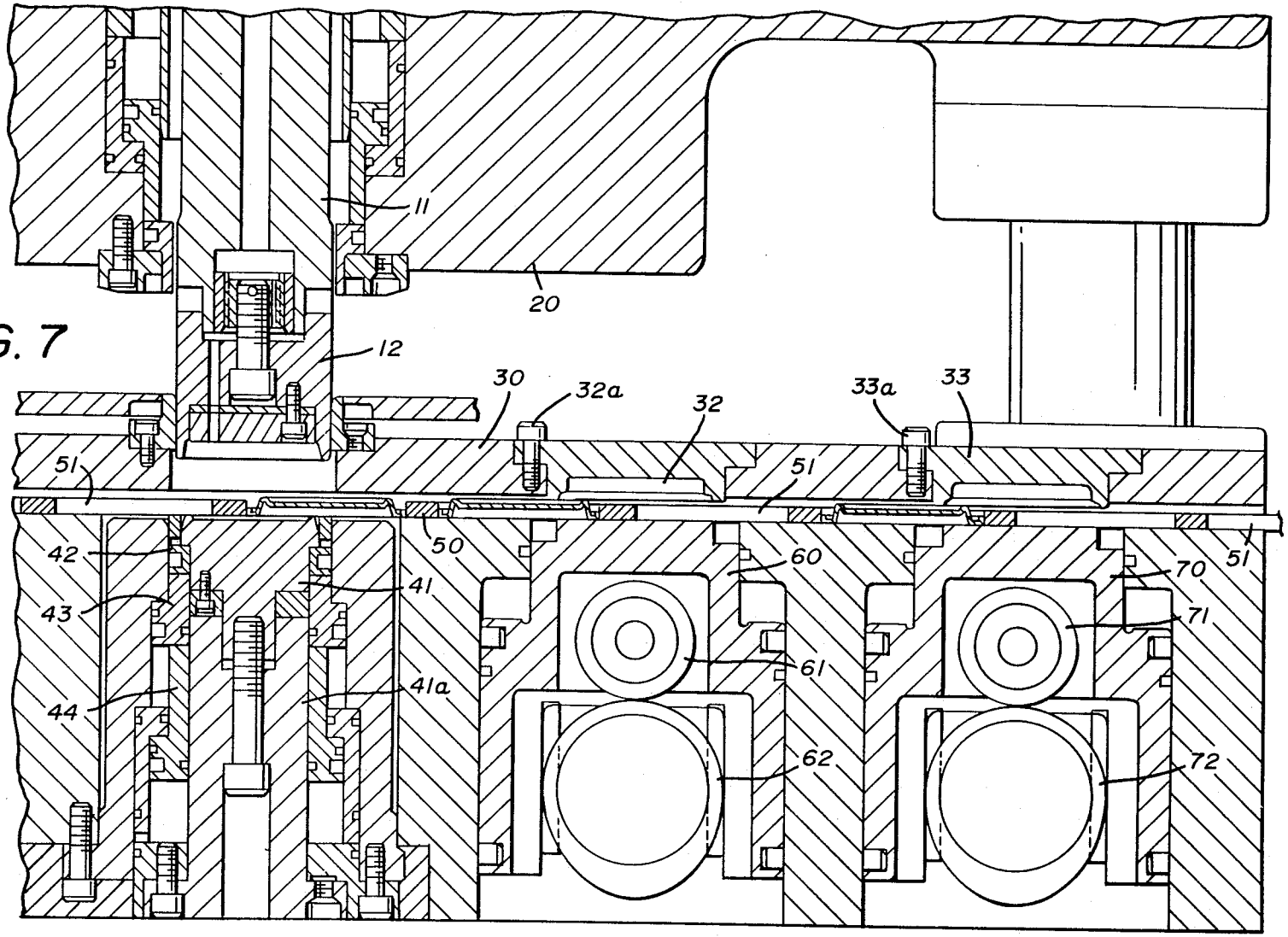
FIG. 7 is an elevational view, partially in section, showing the transfer of the ends from one station to another.

Spaced laterally of the tooling just described in FIG. 3 is tooling suitable for reforming the end and for curling the end, as can be seen in FIGS. 1, 2 and 7 with it being again noted that, in effect, only one primary tooling station and one set of auxiliary tooling is being described in detail.

Figure 8:
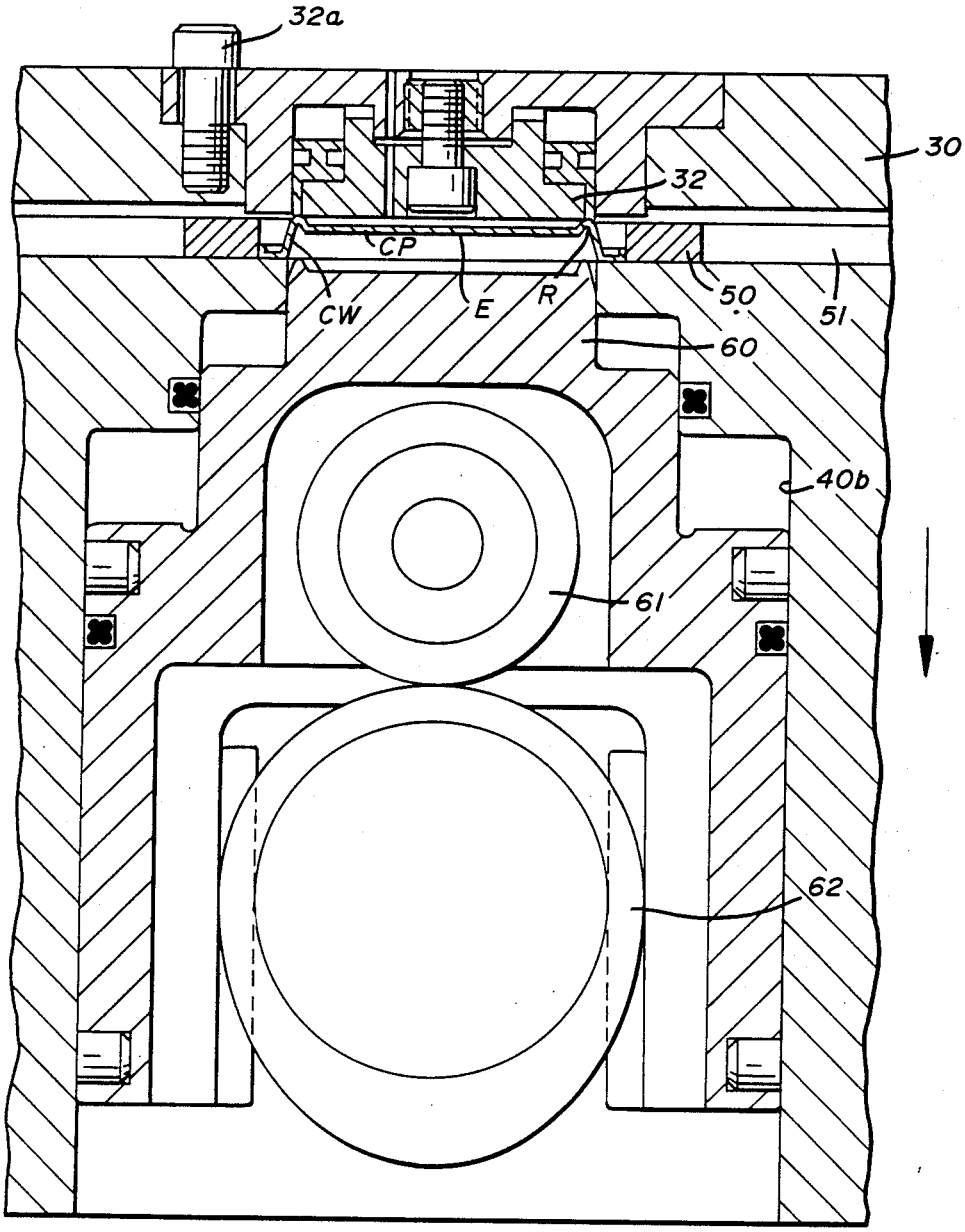
FIG. 8 is an enlarged elevational view, partially in section, showing the tooling for reforming the end in the down or receiving position.
Figure 9:
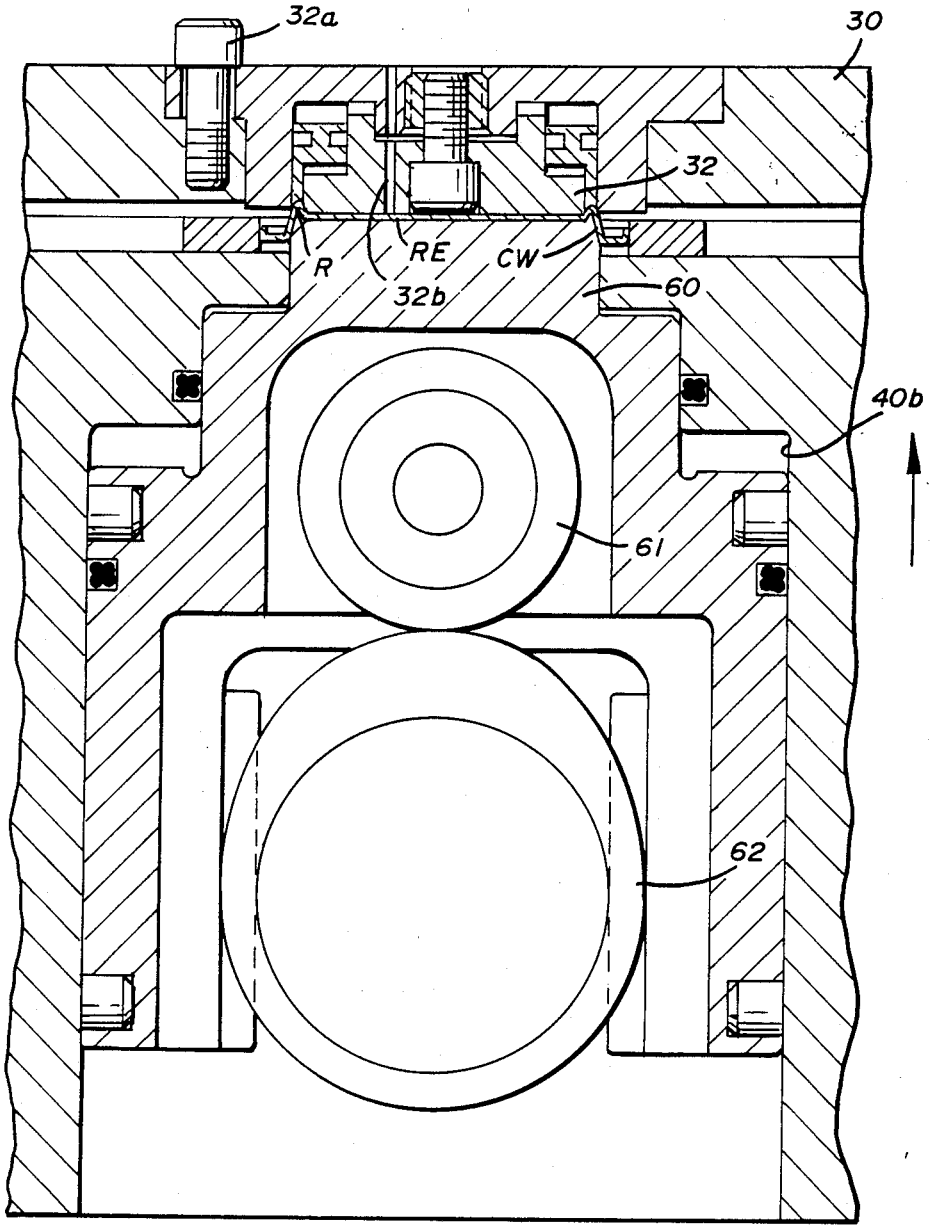
FIG. 9 is an enlarged elevational view, partially in section, showing the tooling for reforming the end in the up or reforming position.

Referring then to FIGS. 7 through 9, the reforming station essentially includes a reforming die 32 carried on the die holder 30 by one or more screws 32a. Beneath that die 32 is a punch 60 which is reciprocally mounted in cavity 40b of the bolster plate 40. A cam 62 is disposed therein and rotation of the cam by conventional means (not shown) will move the rise of the cam into engagement with cam follower 61 to elevate the punch 60 so as to force the preliminarily formed end up against the die 32 so as to reform it. In FIG. 8, the cam is shown rotated down so as to permit the end E to be moved into and out of position at the reform station. FIG. 9 shows the reform tooling in the up position with the end having been reformed.

Figure 10:
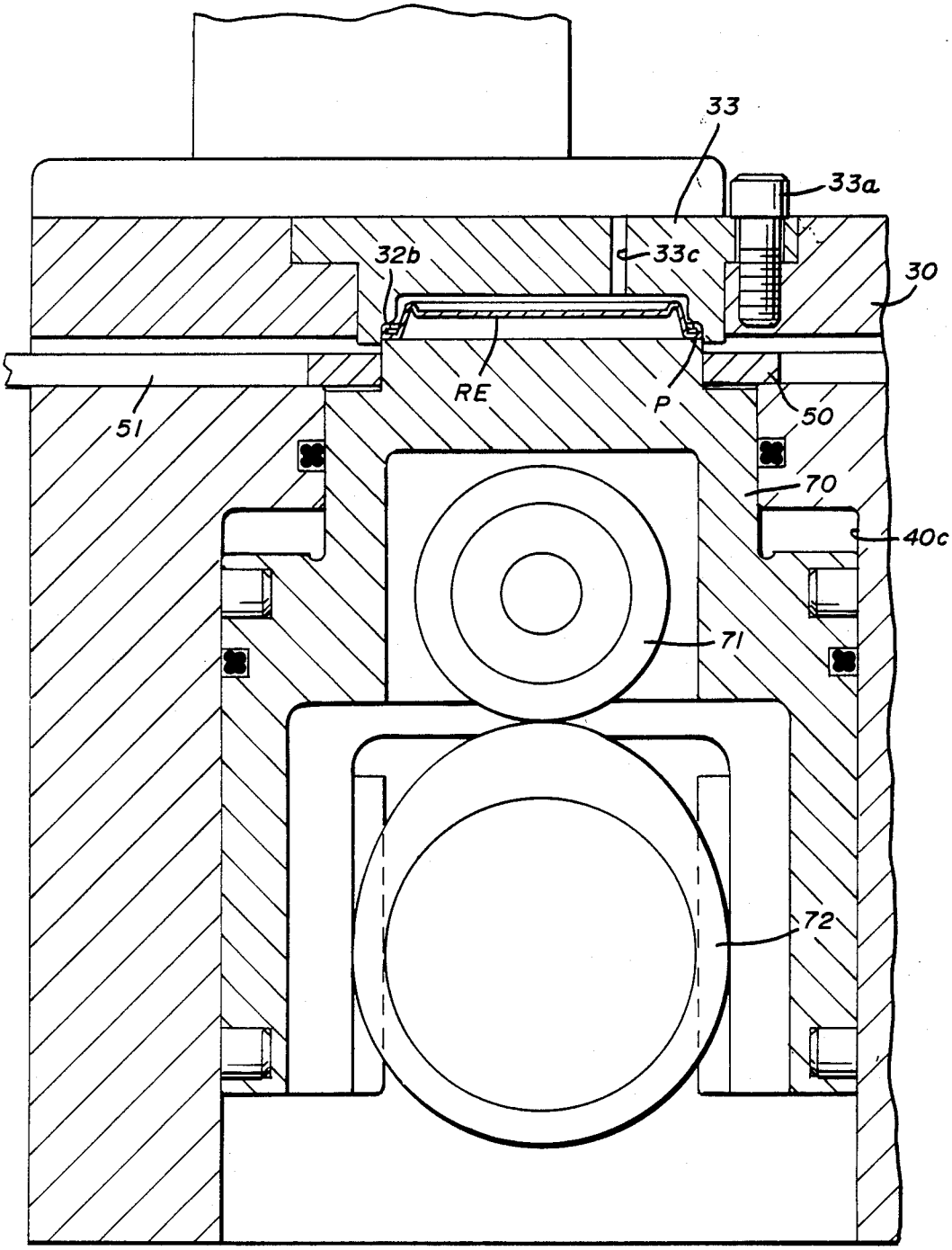
FIG. 10 is an enlarged elevational view, partially in section, showing the tooling for curling the end in the up or curling position.

The curling station illustrated in FIG. 10 is somewhat similar, except that the die 33 is configured somewhat differently so as to curl the peripheral edges of the end. Thus, die 33, which is mounted on die plate 30 by one or more screws 30a, has a contoured annular recessed area 33a suitable for the curling operation.

The curling punch 70, which is slidably received in bore 40c of base 40 is dimensioned so as to support the radiused area of the shell, as shown in FIG. 10. Movement of punch 70 is controlled by cam 72 and cam follower 71. It will readily be noted that the curling tooling is illustrated only in the up position, but would be moved down in a fashion similar to that illustrated with regard to the reform station in FIG. 8 to permit the end to be moved into and out of the station.

It will also be noted that through bore 33c is provided in die holder 30 and may be connected to a source of air to assist in moving the curled end back into the belt 50 if required. A similar bore 32b is present at the reform station of FIGS. 8 and 9 for the same reason.

In use or operation of the improved device, it will be assumed that the material M is fed into the press along the stock plate 31 in the direction of arrow X (see FIG. 2). The outer slide holder 20 will be moved to the down position of FIG. 3 and fluid pressure exerted on the piston 23 through bore 20a will force the first pressure sleeve 22 into holding relationship with the material M. Further downward movement of outer slide holder 20 will cause the cut edge 24 to blank the material against cut edge 31a, as can be clearly seen in FIG. 3 of the drawings. In that regard, it will be noted that cut edge 31a is carried on die holder 30 and does not move. As previously noted, however, stock plate 31 is fluidly supported (see FIG. 3A). Therefore, downward movement of cut edge 24 will depress stock plate 31 a sufficient distance to permit the blanking operation to take place.

Figure 4:
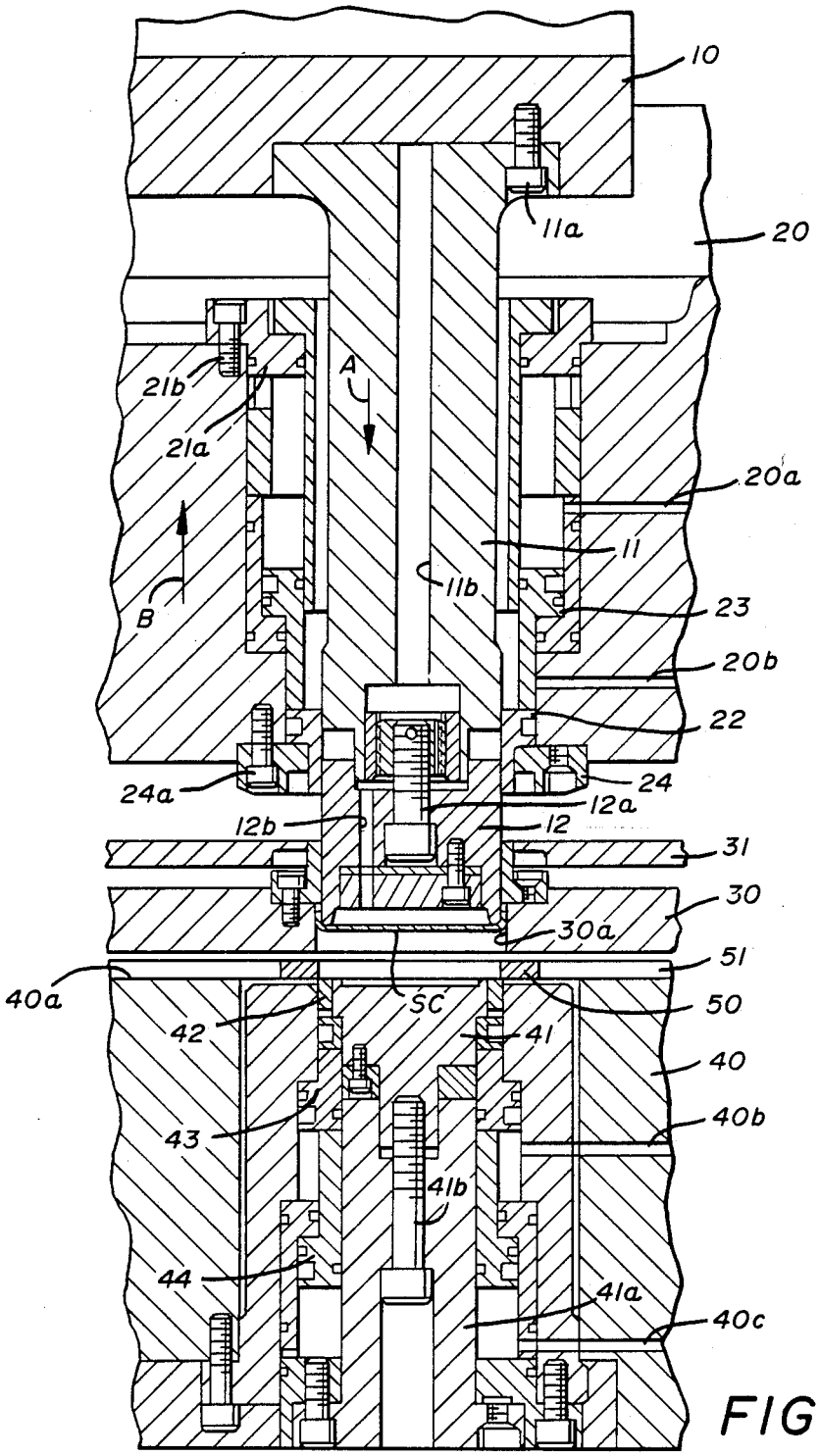
FIG. 4 is an elevational assembly view, partially in section, showing the tooling during formation of the cup.

Turning then to FIG. 4 of the drawings, it will first be noted that stock plate 31 has a through aperture 31b and the die holder 30 has a through aperture 30a. Continued downward movement of the inner slide holder 10 forces the punch 12 down against the previously blanked material M, pulling it out of its previously clamped position beneath sleeve 22 and forming it into a shallow cup SC. As can be seen in FIG. 4, the inner slide holder 10 continues downwardly, as indicated by the arrow A, while the outer slide holder 20 is retracting. It will also be noted that the shallow cup SC carried on the end of the punch 12 is forced down through the apertures 30a and 31b in the die holder 30 and stock plate 31 for further operation. As previously noted, this makes it possible to take the cup through the press following initial forming below the entry level of the raw material on the top of stock plate 31, thereby greatly facilitating speed of operation of the apparatus.

Figure 11:
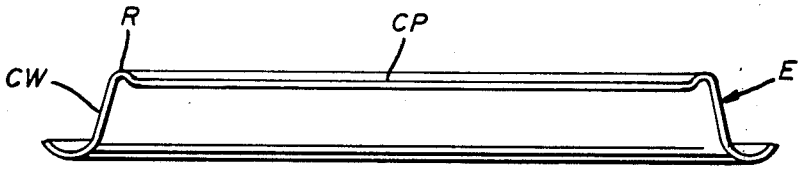
FIG. 11 is a sectional view of the end following the preliminary forming of FIGS. 3 and 4.
Figure 5:
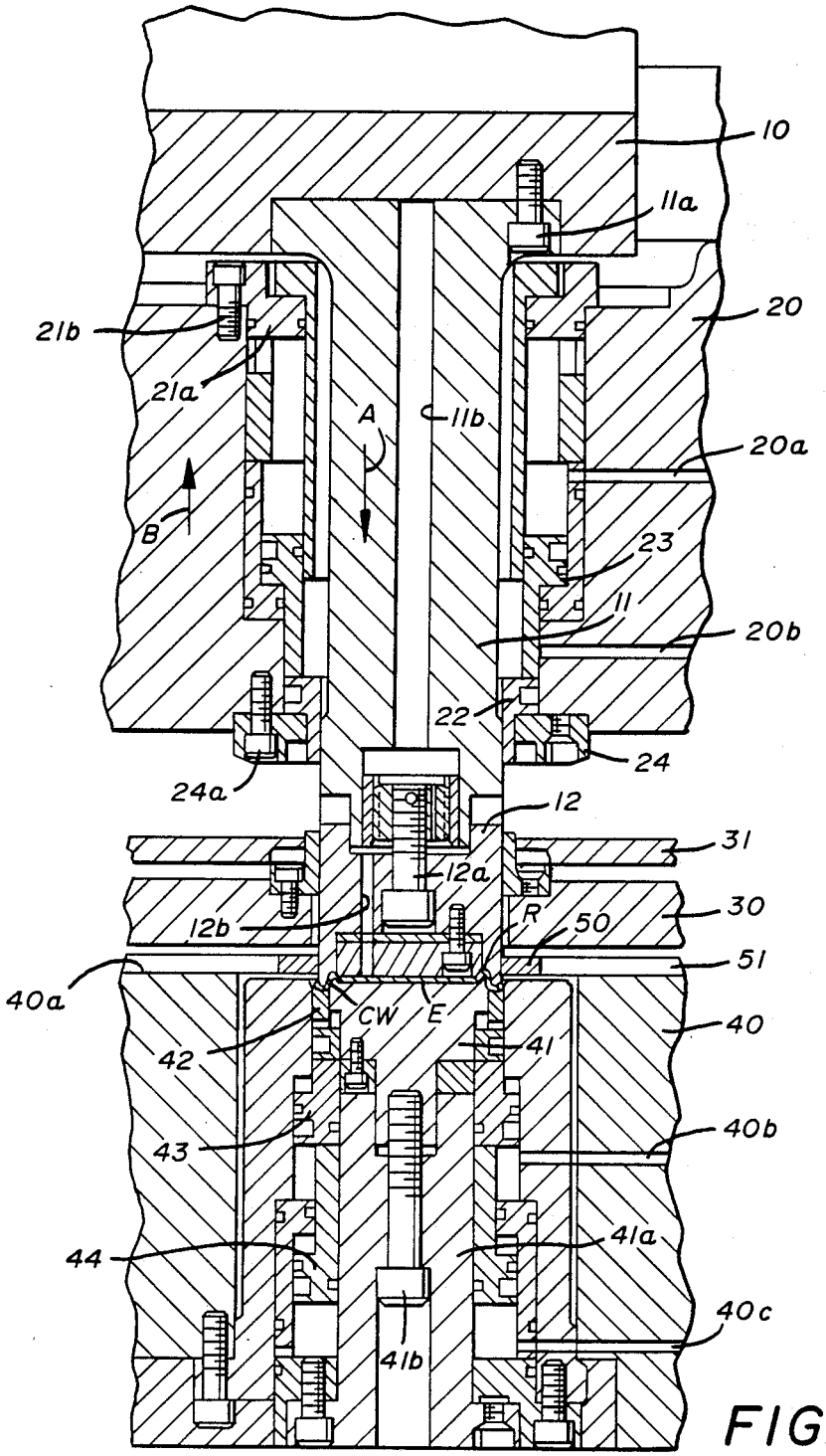
FIG. 5 is an elevational assembly view, partially in section, showing the tooling during the preliminary forming of the end.

Turning then to FIG. 5 of the drawings, it will be seen that a preliminarily formed end E having the general configuration of that shown in FIG. 11 of the drawings will be formed. This is accomplished by continued downward movement of the inner slide holder 10 carrying the shallow cup SC of FIG. 4 down through the aperture 30a and the die holder 30 until it contacts the die core 41 carried by the bolster 40. This die core is fixed, but the liftout ring 42 is not fixed. Thus, movement of the contoured nose of the punch 12 against the die core 41 will force the knockout ring 42 down and preliminarily form the chuckwall CW and radiused area R of the end E (see FIGS. 5 and 11). It will also be noted here that the punch 12 has passed through one of the apertures 51 in the belt 50 and forced end E therethrough as well.

Figure 6:
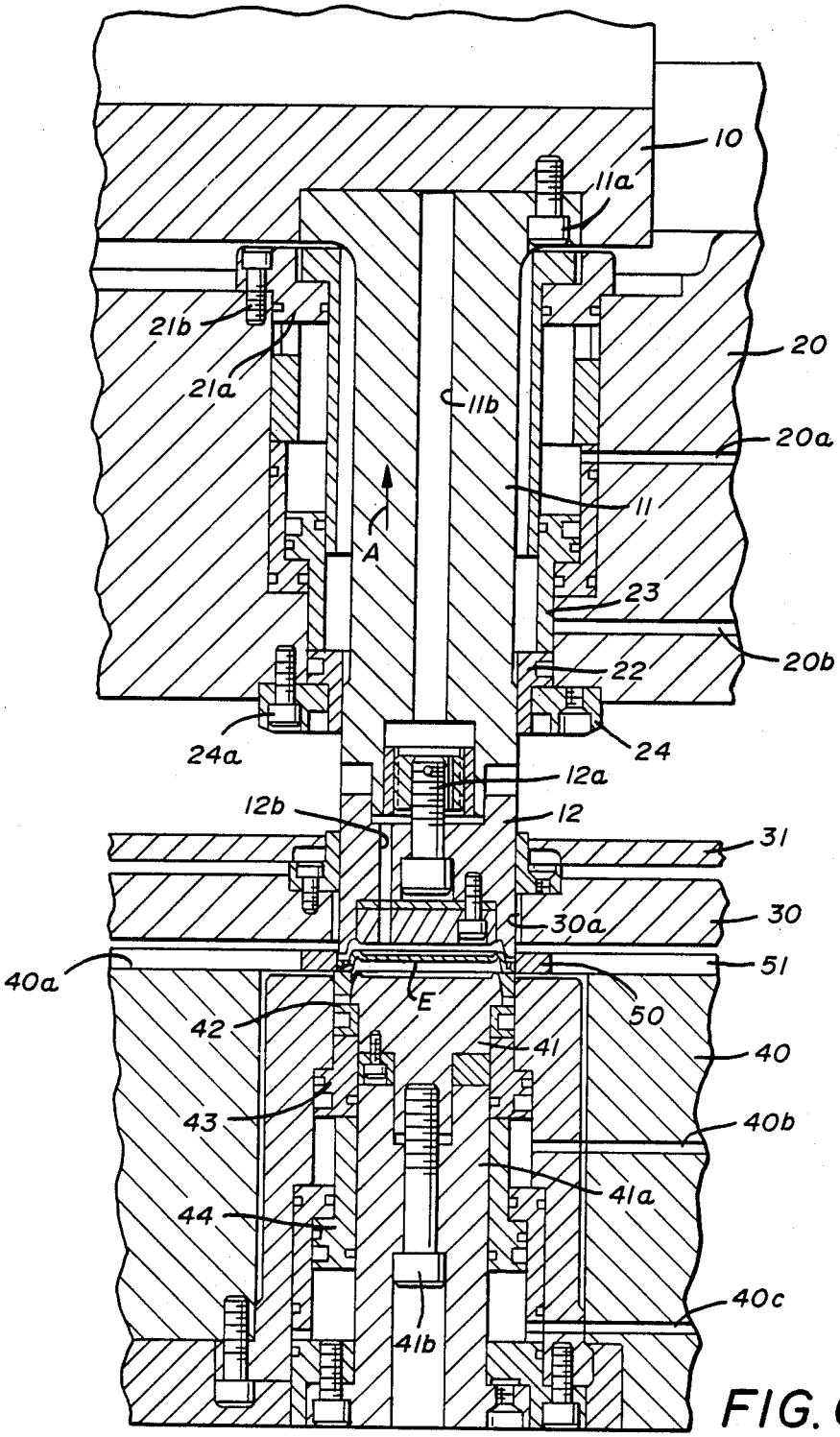
FIG. 6 is an elevational assembly view, partially in section, showing the tooling with the end preliminarily formed and lifted back to the die line.

Referring next then to FIG. 6 of the drawings, it will be seen that the inner slide holder 10 has begun to move upwardly away from the base 40. As soon as the punch 12 lifts off, the fluid pressure on pistons 43 and 44 through bores 40b and 40c from a suitable source (not shown) will push the knockout ring 42 upwardly and it in turn will push the end E up to the position of FIG. 4. At that time, the end is frictionally engaged by belt 50 and held in one of the apertures 51 thereof. As soon as the punch 12 clears the belt 50, the belt can be indexed to an idle station and on to the next adjacent station, as shown clearly in FIG. 7 of the drawings, wherein a series of preliminarily formed ends E are shown deposited in various pockets 51 of the belt 50. It should be noted that in some instances it may be necessary to apply air through bores 12b and 11b of punch 12 and riser 11 to strip the end from the punch.

It should be kept in mind at this point that the end has the general configuration shown in FIG. 11 of the drawings at this stage of the operation.

Referring next to FIG. 8 of the drawings, and assuming that the belt 50 has been indexed sufficiently so as to bring the preliminarily formed end E to the position illustrated in FIG. 8, it will be noted that the cam 62 is rotated down so that the punch 60 is in its retracted position. This, of course, makes it possible to move the end into the position shown in FIG. 8. Rotation of the cam 62, however, as shown in FIG. 9, will move the punch 60 upwardly. The punch 60 has a contoured top surface so that it engages the center panel CP. This upward movement of punch 60 against the die 32 will bring the center panel CP of the end up into contact with the die 32. However, since the punch 60 is engaging the radiused area R of the end, this movement will push the wall area CW over the die 32 and tighten radius R and, in effect, reform the end to form a reformed end RE.

Figure 12:
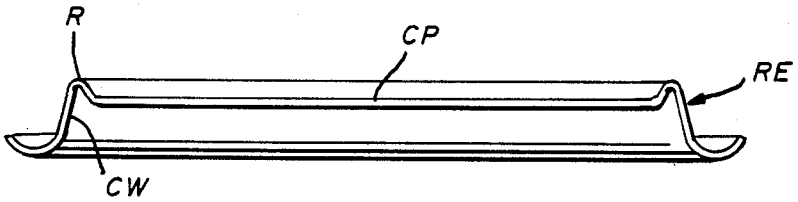
FIG. 12 is a sectional view of the end following the reforming of FIG. 6.

Of course, continued movement of the cam about its center point will permit the punch 60 to drop back down to the position of FIG. 8 whereupon indexing of the belt 50 will move the reformed end RE, which now has the configuration of FIG. 12 of the drawings, to the next station. As previously noted, bore **32*b*** may be connected to a source of pressurized air to assist in returning the reformed end RE to the belt if required.

Reference is now had to FIG. 10 of the drawings wherein the curling station is shown. As previously noted, the tooling here is illustrated in the up or operative position only. The cam 72 and cam follower 71 of this station are similar to that of the station illustrated in FIG. 8. Here, however, the die 33 carried by die plate 30 is of a different configuration and has an annular pocket **33*b* suitable for curling the peripheral edge of the end. In that regard, it will be noted that punch 70 is configured so as to support the end RE about its periphery so that, when the end is forced into pocket 31*b*, the curling operation will be performed. It is believed readily apparent that when the cam 72 is rotated about its center point, the punch 70 will drop down. This further rotation of cam 72 will naturally permit the end to drop down and permit the completed end, which now has the configuration of FIG. 13 of the drawings, to be again deposited in one of the pockets 51 of the belt 50** so that indexing of the belt will remove the end from the station and move it on for further processing.

It is possible that some assistance may be required to strip the end in both the reforming and curling stations as already noted. Thus, air passage **33*c*** may be employed at the curling station.

It will be seen then how a system has been provided in which multiple operations from blanking to curling can be provided in a single press at high speeds with minimal handling and positive control during the various operations.

The multi-level and positive transfer arrangement makes it possible to achieve very high operational speeds while safely controlling and handling the ends.

Turning to FIGS. 14 through 17, an alternative embodiment will be seen which enables the apparatus to achieve the advantages of the embodiment of FIGS. 1 through 12 with increased access to the tooling through a unique disposition of the tooling sets and with reduced maintenance and improved efficiency by modifications to the apparatus for performing the secondary forming operation. Thus, the previously described essential advantages of the multi-level operation and positive transfer arrangement are further enhanced.

Figure 14:
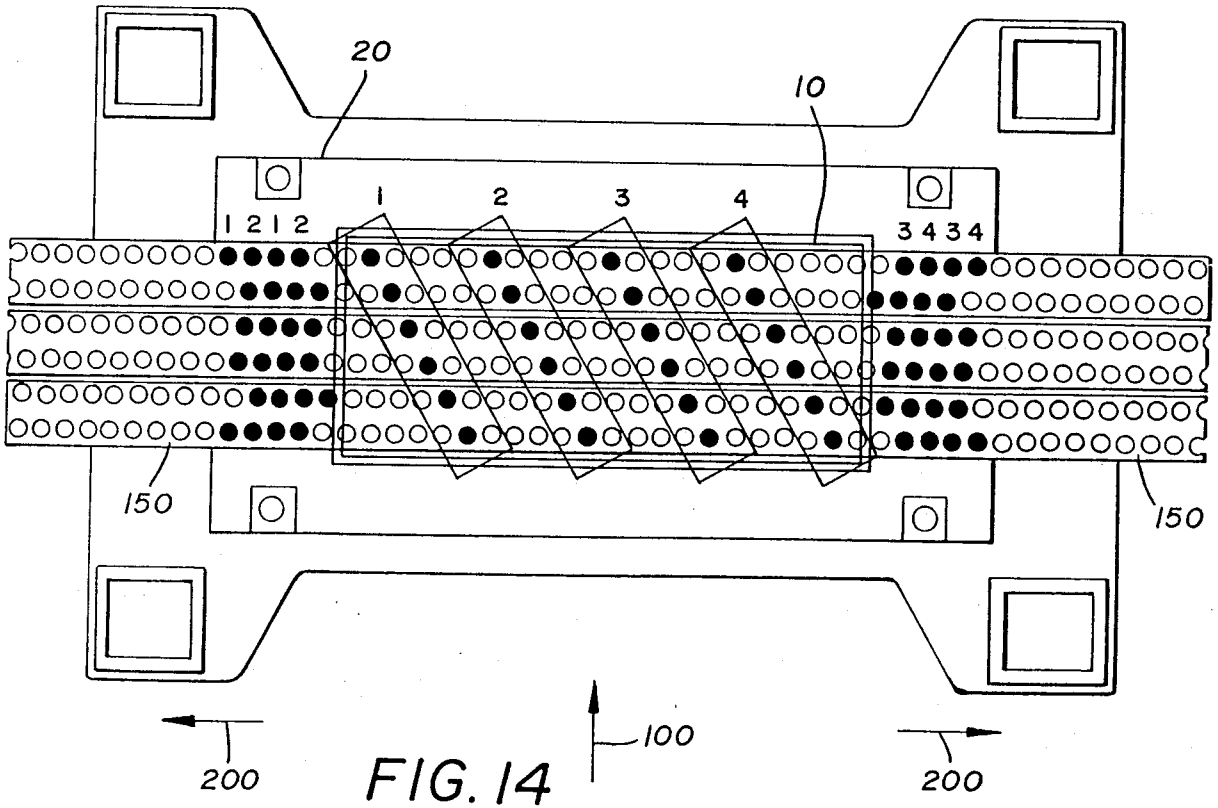
FIG. 14 is a schematic plan view of the tooling arrangement of an alternative embodiment.

Thus, it will be seen from FIG. 14 that the die sets identified by the numerals 1,2,3,4 are disposed at an angle with respect to the longitudinal centerline of the press. This enables multiple "outs" to be achieved on each press stroke (in this case, twenty-four), while avoiding an overly deep press and making it possible to readily access the tooling for maintenance.

In this embodiment, the stock is advanced in the direction of arrow 100 into the press. On the first hit or press cycle, the initial operation will be performed at the stations identified by the dark circles. In the form of the invention illustrated, twenty-four such operations will take place on each cycle. It will be understood that the preliminary forming operation previously described will be the same in the alternative embodiment.

The belts 150,150 are then indexed in opposite directions away from the press centerline and the material feed direction 100 as indicated by arrows 200,200, taking twelve pieces away in each direction for further operations as previously described. In that regard, the belts 150,150 are indexed slightly more than two part diameters on each press cycle. This disposes an empty belt pocket in position for the next forming operation and ultimately transfers the ends to the pre-curl and final curl stations. The operation can then be repeated as desired with the material being moved into the press as required.

This effectively permits reduction of the front to rear depth of the press by about fifty percent. That is, with a twenty-four out set up, one has four rows of six tooling stations rather than the conventional two rows of twelve. This concept can be best understood by reference to FIG. 2 of the drawings where a more conventional tooling arrangement is illustrated.

Figure 15:
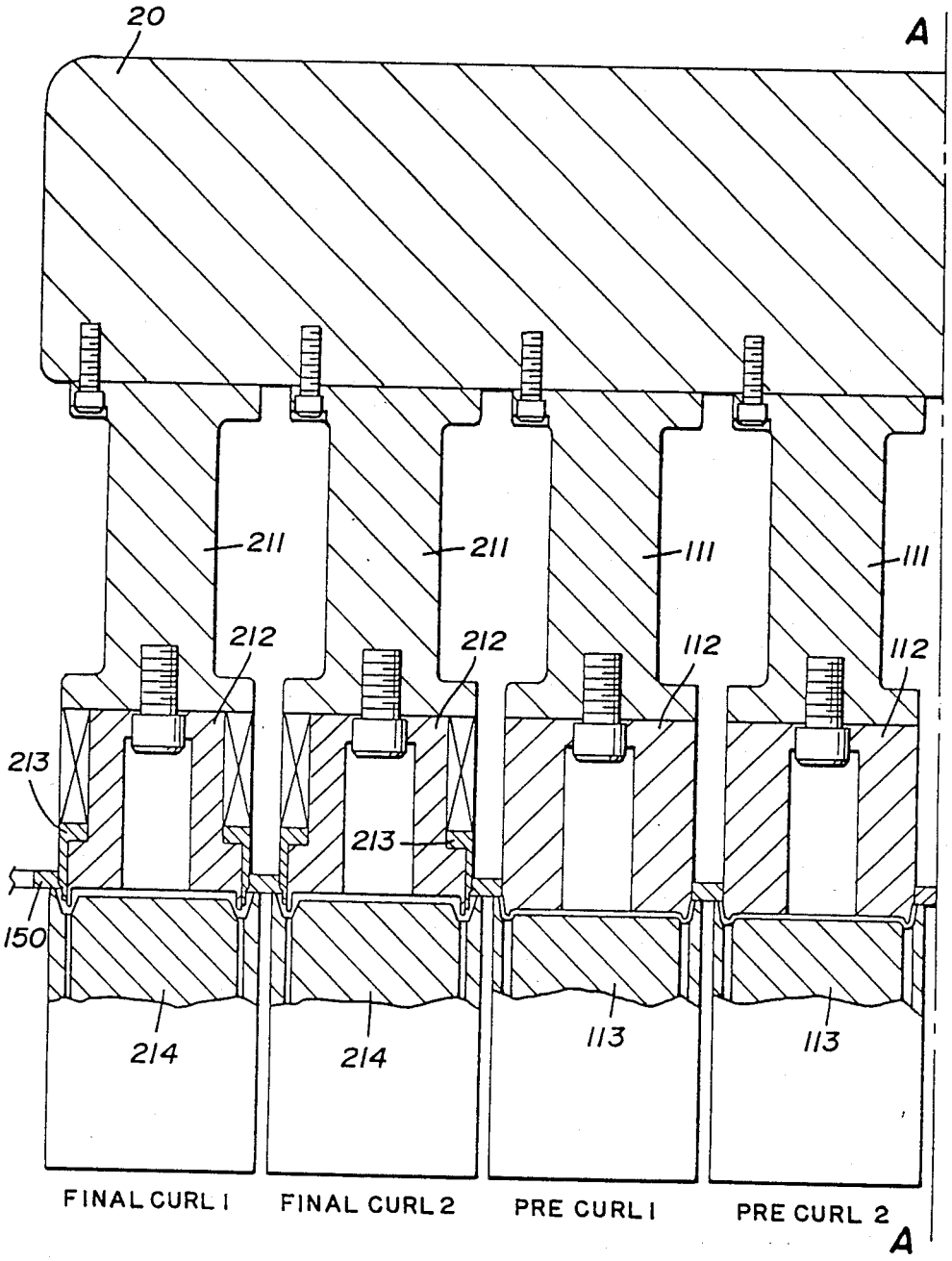
FIGS. 15 and 15A are elevational views partially in section and partially schematic illustrating the apparatus of the alternative embodiment of FIG. 14.
Figure 15A:
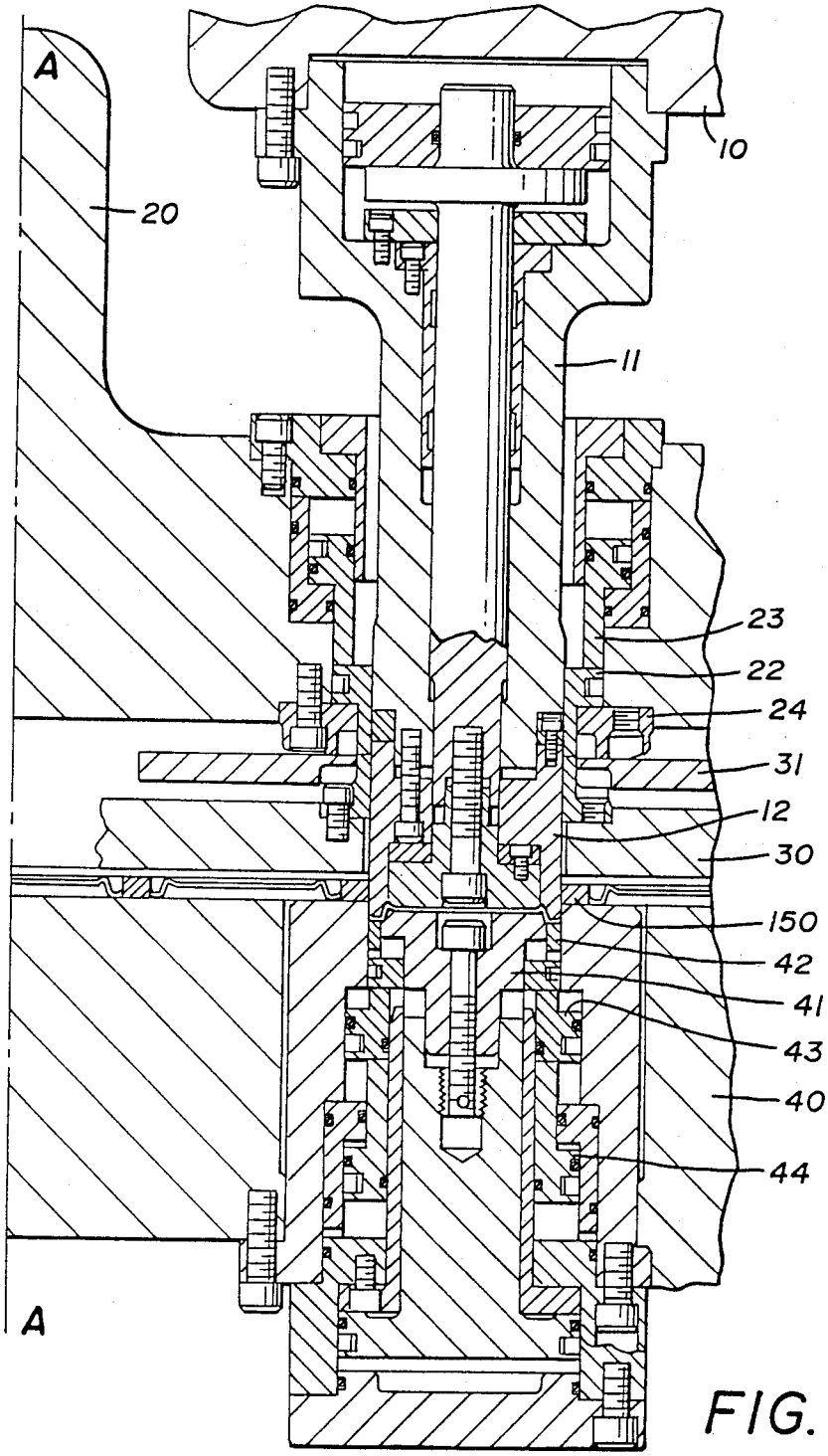

Reference to FIG. 15 also illustrates this concept. There, it will be seen that each "1" part will be indexed to a "1" pre-curl station and each "2" part will be indexed to a "2" pre-curl station. These stations are alternated along the path of belt movement designated by arrows 200. Then, on each belt double indexing movement, the ends are moved to final curl stations as can be clearly seen in FIG. 15. Of course, it will be understood that a similar operation will take place on the opposite side of the press with regard to the ends formed by the tooling designated by the numerals 3 and 4.

The alternative embodiment also provides a further advantage. In the embodiment of FIGS. 1 through 13, the secondary operations are performed by employing cam and cam follower mechanisms such as 61,62 and 71,72. While fully effective, such mechanisms may present some maintenance and access difficulties. Thus, the alternative embodiment presents a simplified alternative approach as can be seen in FIGS. 16 and 17.

It will first be noted that the initial forming station illustrated in FIG. 15 includes apparatus similar to that of the embodiment of FIGS. 1 through 13 and is illustrated in a position comparable to that of FIG. 5. Accordingly, comparable components have been identified with the same reference numerals except for the belt which is now identified by the numeral 150.

Figure 13:
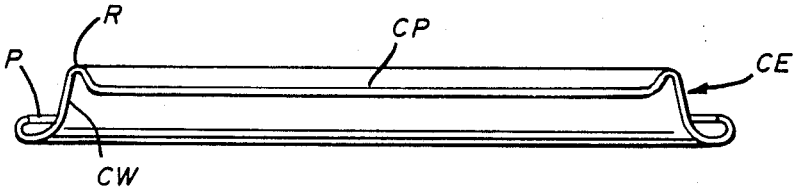
FIG. 13 is a sectional view showing the end following the curling of FIG. 7.
Figure 16:
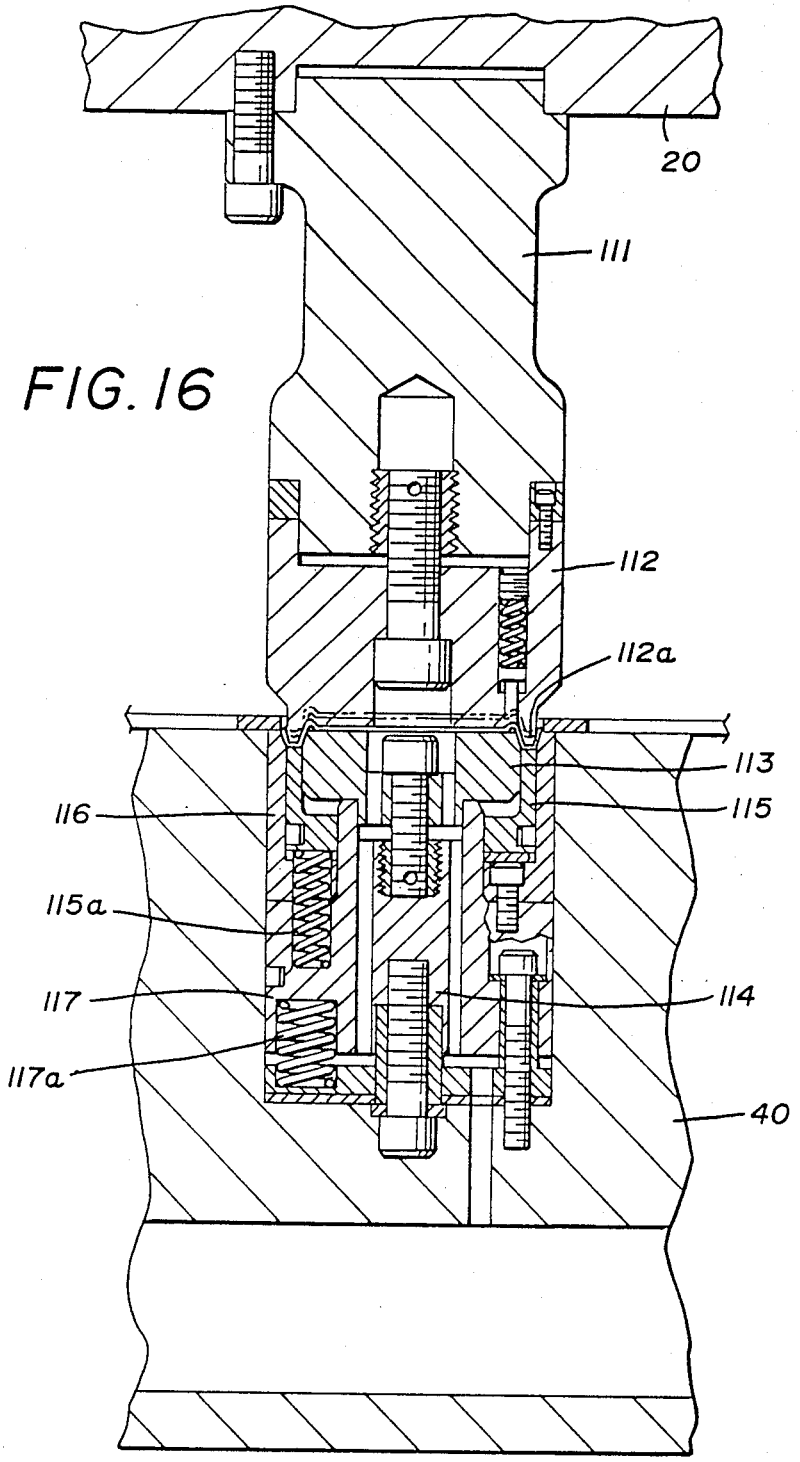
FIG. 16 is an enlarged elevational view of the precurl apparatus of the alternative embodiment of FIG. 14.
Figure 17:
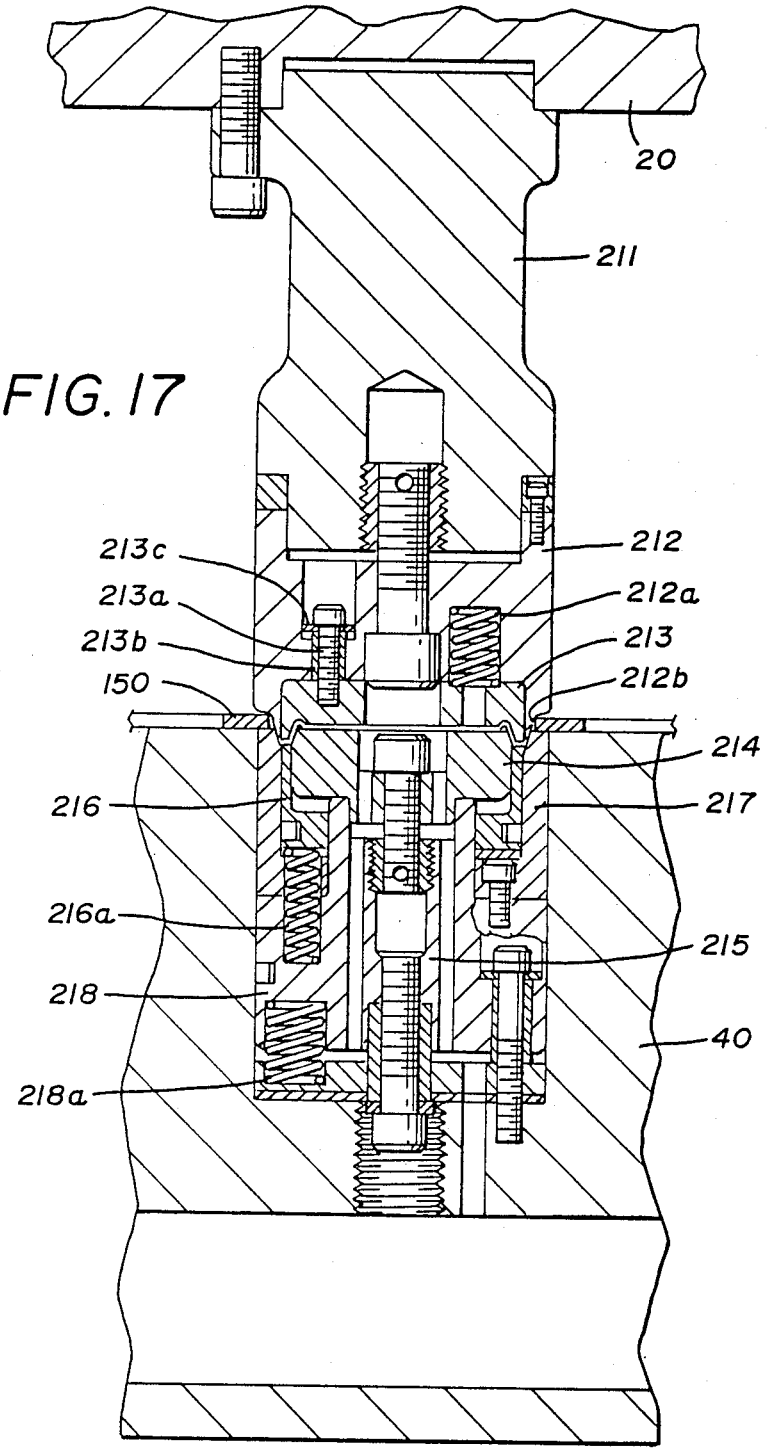
FIG. 17 is an enlarged elevational view of the curl apparatus of the alternative embodiment of FIG. 14.

Referring then to FIGS. 16 and 17, it will be seen that the pre-curl and curl stations encompass different forming apparatus and form the ends to the configurations of FIGS. 12 and 13, respectively.

Referring first then to FIG. 16, it will be seen that the outer slide holder 20 carries a punch center post 111 and a pre-curling punch 112. This punch has an annular nose 112*a*. The press base 40 receives a die core 113 which is mounted on a die core post 114.

Concentrically surrounding die core 113 is a knock-out piston 115 which is supported by spring 115*a* which normally urges piston 115 upwardly to return the end to belt level after the pre-curling operation.

Further outboard of piston 115 and concentric therewith is pre-curling die 116 which is received on a spring assembly 117 which is supported by spring 117*a* and which also supports die core 113.

In operation, as punch 112 is advanced toward base 40 by movement of outer slide holder 20, the nose 112*a* engages the wall CW of the end (see FIGS. 11 and 12) against the beveled periphery of die core 113 and forces the end into the area between the die core 113 and the pre-curl die 116 overcoming the force of spring 115*a* beneath piston 115. This movement pulls the material downwardly and initiates a curl so that the end assumes the configuration of FIG. 12.

When outer slide holder 20 retracts, the spring 115*a* causes piston 115 to lift the end back up to the level of belt 150 where it is received in a pocket for suitable indexing for further operations.

It will be noted that a press expansion feature is also provided. It is well-known that presses of this type may "grow" as they heat up. As can be seen in FIG. 16, the spring 117*a* supports spring assembly 117, pre-curl die 116 and die core 113 so that, once punch 112 bottoms on the end against die core 113, any further movement of the elements will be together. Once this operation has been completed, the usual double indexing of belt 150 will move the end to final curl station 1.

Turning then to FIG. 17 of the drawings, it will be seen that the final curl station also includes a punch center post 211 which is secured to the outer slide holder 20. Affixed to that center post is a curling punch 212. That curling punch is bored to receive one or more springs 212*a* which bear against insert 213. In addition, insert 213 is slidingly connected to the punch 212 by one or more screws 213*a* which slides in bushing 213*b* and carries a stop 213*c*. By that means, the punch insert 213 is movable slightly relatively of the punch 212 and the distance by which the nose of the insert projects ahead of the nose 212*b* of the punch may be controlled.

The punch 212 has an annular nose 212*b* and the punch insert 213 also has an annular nose 213*b* received concentrically inside nose 212*b*.

Received on the base 40 is a die core 214 which is mounted on a die core post 215. Received in concentrically encircling condition with die core 214 is a knock-out piston 216 which is supported by a spring 216*a*. The spring would normally urge the piston upwardly toward the belt 150.

Still further outboard and concentrically disposed is a curling die 217 and die post 215. A spring assembly 218 is disposed beneath curling die 217 and also engages die core 214 with the entire assembly being supported by the spring 218*a*. This arrangement is similar to that of the pre-curl station wherein this arrangement permits accommodation for growth of the press due to heating. Thus, it will be seen that, once the punch insert 213 has bottomed against the part on the top of the die core 214, any further movement of the components will be in unison in that the curling punch 217, the die core post 215 and the die core 214 will all move together, again so as to avoid disturbing the depth of the countersink radius and center panel of the end once it is finally set.

In operation of the curling station, it will be assumed that the outer slide holder 20 will be moved toward the base 40. Contact will initially be made by the nose 213*b* of the punch insert 213. This will engage the chuckwall CW of the end (see FIG. 13) against the beveled perimeter of the die core 214. In cooperation with the top of curl die 217, it will then begin to draw the material from the periphery of the end toward the chuckwall. As previously mentioned, the nose of insert 213 leads nose 212*b* of punch 212. Therefore, for a brief period of time, it will cause this movement and the peripheral edge of the end will then be partially curled inwardly toward the chuckwall. As the punch 212 catches up, the nose 212*b* of the punch will engage this peripheral edge and complete the curling operation.

Of course, once the outer slide holder 20 is retracted, the piston 216 will move the finished part back up to the belt 150 where it will be received in a pocket so that it can be transferred out of the press.

While a full and complete description of the invention has been set forth in accordance with the dictates of the Patent Statutes, it should be understood that modifications can be resorted to without departing from the spirit hereof or the scope of the appended claims.

In that regard, it will be noted that the invention has been illustrated in connection with the forming of beverage container ends, but sanitary ends having a profiled surface could also be produced thereby by adding profiling tooling to the stations illustrated in FIGS. 3 through 6.

Additionally, while Applicant has illustrated and described a cam actuated operation at the reforming and curling stations in the embodiment of FIGS. 1 through 13, other activating means such as pistons, for example, could be employed or the secondary operations can also be performed as illustrated in FIGS. 14 through 17.

Finally, the invention is not intended to be limited to the production of circular ends, but can also be used to produce other shapes such as rectangular, oblong or irregularly shaped and sized ends.

What is claimed is:

1. A method of forming container end panels from material fed into a press, comprising the steps of:

(a) clamping the material and forming a blank therefrom;

(b) forming a cup from the blank in a continuous press stroke;

(c) imparting a preliminary end panel configuration to said cup in the same continuous press stroke;

(d) passing the cup through the die used for forming the cup prior to step c; and (e) transferring the cup normally with respect to the direction in which the material is fed into the press.

2. The method of claim 1 wherein a plurality of cups are formed in each press stroke; some of the cups are transferred in a first direction normal to the direction the material is fed into the press and some of the cups are transferred in an opposed direction.

3. The method of claim 2 wherein the tooling for performing steps a through d is disposed along a line at an angle with respect to the centerline of the press.

4. The method of claim 2 wherein a pocketed belt passes through said press with its pockets spaced so as to be in alignment with the tooling for performing steps a through c.

5. The method of claim 1 wherein a plurality of cups are formed in each press cycle; the tooling for forming the cups is disposed in parallel rows disposed at an angle with respect to the centerline of the press; and some of the cups are transferred in a first direction normal to the direction in which the material is fed into the press and some of the cups are transferred in an opposed direction.

6. The method of claim 5 wherein pocketed belts pass through the press; and the pockets of said belts are spaced so as to be in alignment with the tooling for performing steps a through c.

7. The method of claim 6 wherein at least one tooling station for performing secondary operations is disposed within the press at opposed ends thereof; and ends are transferred to said tooling stations by said belt.

8. The method of claim 6 wherein an even number of said parallel rows of tooling are provided; and said belts are indexed slightly more than twice the diameter of the cups following each press cycle.

9. The method of claim 6 wherein first tooling stations are disposed within the press at opposed ends thereof; and said cups are pre-curled at said first tooling stations.

10. The method of claim 9 wherein second tooling stations are disposed within the press at opposed ends thereof; and said cups are curled at said second tooling stations.

11. The method of claim 9 or 10 wherein an even number of said parallel rows of tooling are provided; and said belts are indexed slightly more than twice the diameter of the cups following each press cycle.

12. Apparatus for forming container end panels from material fed into a press, comprising;

(a) at a first station, tooling carried by the press for blanking the material at a first level and preliminarily forming the blanked material into end panel configuration at a second level;

(b) at a second station, tooling carried by the press for performing a second operation on the preliminarily formed end panel at said second level;

(c) said second station being disposed laterally of the direction the material is fed into the press; and (d) transfer means for interconnecting said first and second stations.

13. The apparatus of claim 12 wherein, at a third station, tooling is carried by the press for performing a third operation on the end panel at said second level; and said third station is disposed laterally of the direction the material is fed into the press.

14. The apparatus of claim 12 wherein said first station includes a plurality of rows of said tooling disposed in parallelism with each other and at an angle with respect to the direction the material is fed into the press.

15. The apparatus of claim 14 wherein said second station includes sets of tooling disposed on each end of the press; and said transfer means interconnect selected of said rows of tooling of said first station with one of said sets of tooling of said second station.

16. The apparatus of claim 15 wherein said transfer means include pocketed belts, some running in a first direction normal to the direction material is fed into the press and some running in an opposed direction.

17. The apparatus of claim 14 wherein said third station includes sets of tooling disposed on each end of the press outboard of the tooling of said second station; and said transfer means interconnect selected of said rows of tooling of said first station with one of said sets of tooling of said third station.

18. The apparatus of claim 17 wherein said transfer means include pocketed belts, some running in a first direction normal to the direction material is fed into the press and some running in an opposed direction.

19. The apparatus of claim 12 or 15 wherein said tooling of said second station includes a pre-curl punch carried by the upper platen of the press and movable toward the base thereof; and a pre-curl die carried by the base.

20. The apparatus of claim 19 wherein said pre-curling die is supported on the base of the press by at least one spring.

21. The apparatus of claim 13 or 17 wherein said tooling of said third station includes a curling punch assembly carried by the upper platen of the press and movable toward the base thereof; and a curling die carried by the base.

22. The apparatus of claim 21 wherein said curling punch assembly includes a curling punch having a projecting annular nose; a curling punch insert having a projecting annular nose telescoped interiorly of said annular nose of said punch and adjustably connected to said curling punch; and a curling die carried by the base.

23. The apparatus of claim 22 wherein said curling die is supported on the base of the press by at least one spring.

* * * * *